US007007315B2

(12) United States Patent
Stonecipher

(10) Patent No.: US 7,007,315 B2
(45) Date of Patent: Mar. 7, 2006

(54) SELF-SUSTAINING BASE

(75) Inventor: Christopher Scott Stonecipher, Jackson, TN (US)

(73) Assignee: The Praxis Companies, LLC, Savannah, TN (US)

( * ) Notice: Subject to any disclaimer, the term of this patent is extended or adjusted under 35 U.S.C. 154(b) by 0 days.

(21) Appl. No.: 10/447,901

(22) Filed: May 29, 2003

(65) Prior Publication Data

US 2004/0237187 A1 Dec. 2, 2004

(51) Int. Cl.
*A47K 3/28* (2006.01)

(52) U.S. Cl. ..... 4/613

(58) Field of Classification Search ..... 4/592, 4/613, 584

See application file for complete search history.

(56) References Cited

U.S. PATENT DOCUMENTS

| | | | | |
|---|---|---|---|---|
| 2,784,417 | A | 3/1957 | Strand | |
| 3,675,384 | A | 7/1972 | Knecht | |
| 4,541,132 | A | 9/1985 | Long | |
| 4,557,004 | A | 12/1985 | Piana | |
| 4,938,825 | A | 7/1990 | Macdonald | |
| 5,140,789 | A | 8/1992 | DeGooyer | |
| 5,845,347 | A | 12/1998 | Young | |
| 6,003,169 | A * | 12/1999 | Davis, Jr. | 4/613 |
| 6,238,604 | B1 | 5/2001 | Pieper | |
| 2003/0008164 | A1 * | 1/2003 | Klepsch | 428/520 |

FOREIGN PATENT DOCUMENTS

| | | | |
|---|---|---|---|
| WO | 99/43248 | * | 2/1999 |

* cited by examiner

*Primary Examiner*—Charles E. Phillips
(74) *Attorney, Agent, or Firm*—Waddey & Patterson, P.C.; Phillip E. Walker

(57) ABSTRACT

A base for a shower stall comprising a first layer of fiber glass and resin, and layer of filament material, and a second layer of fiberglass and resin. The base also includes at least one external edge, an external opening, and a thickness that increases from the at least one external edge to the internal opening. Included is a shower stall comprising a plurality of shower walls, a sloped floor attached to the shower walls, and a base attached to the slope floor. Also included is a method of attaching a base to a shower stall. The method comprises creating the base by applying fiberglass, resin, and filament material to a mold, engaging the base to the shower stall by removably attached the mold to the shower stall, curing the base, and removing the mold from the shower.

13 Claims, 8 Drawing Sheets

SELF-SUSTAINING BASE

A portion of the disclosure of this patent document contains material that is subject to copyright protection. The copyright owner has no objection to the facsimile reproduction by anyone of the patent document or the patent disclosure, as it appears in the Patent and Trademark office file or records, but otherwise reserves all copyright rights whatsoever.

Be it known that I, Christopher Scott Stonecipher, of Jackson Tennessee have invented a new and useful "Self Sustaining Base."

FIELD OF THE INVENTION

The present invention relates generally to a base for shower stall and more particularly to an integral base formed as part of the floor of a barrier free shower stall prior to installation of the shower stall.

BACKGROUND OF THE INVENTION

Senior living facilities, hotels, resorts and government buildings are required to have a percentage of their rooms accessible to the disabled and compliant with the Americans with Disabilities Act (ADA). Within ADA, two shower units are defined and described. The two configurations are intended to facilitate the use of shower units by wheel chair bound individuals and to prevent barriers of entry for these individuals and other disabled individuals.

The descriptions for the two ADA units include parameters for threshold clearances from the bathroom floor into the shower unit. ADA allows a 36"×36" inside dimension shower (Shower A) and a 60"×36" or 60"×30" inside dimension shower (Shower B). Shower A is allowed a ½" height variation from the bathroom floor to the top of the threshold of the shower unit and Shower B is allowed a "flush" installation of the top of the threshold of the shower unit to the bathroom floor.

Shower units must have draft, or slope, in the shower floor from the outside edges through all points to the drain. Industry standard is to provide these shower units with 2 inch thresholds meaning on shower A, a 1½ inch recess is required to meet the threshold code and in shower B, a 2 inch recess is required to meet the threshold code. Site preparation to install a compliant unit requires one of two options: 1) a pit in the site floor must be created where the shower is to be installed; or 2) the bathroom floor must be built up to the corresponding height required to be ADA compliance. Both of these installation procedures are very costly and time consuming to construct. Even if showers are manufactured with lower thresholds, floor manipulation is still necessary.

Standard shower units are manufactured with base reinforcement that allows for ample structure to sustain the user's weight. The space required for this reinforcement does not cause any problems with a standard unit as there is no threshold entry issue. With ADA compliant units, however, the low shower threshold heights do not allow enough space to add reinforcement to the shower floor. The small clearance restricts the insertion of the conventional amount of support materials necessary for reinforcement. Using the standard shower support materials under barrier free shower floors fails to adequately support the shower floor for the end user. As a result, ADA units require special installation.

Conventional techniques place slurry between the construction floor and the shower floor. The application of the slurry is very expensive due to both the materials used and the labor costs. Further, use of the slurry is difficult. During installation, maintaining the draft of the shower floor is difficult with the slurry. Also, maintaining the complete contact between the shower floor and the slurry is difficult. Conventional techniques used to address these problems include bracing the shower floor to confirm the proper draft was maintained. Also, normally 48 hours is the amount of time required for the slurry to cure. Once again, this adds extra cost to the installation of the ADA compliant showers.

Also, the slurry requires a certain temperature level before it can be poured. Typically, slurry cannot be poured when temperatures do not exceed daily levels required for concrete use. This obviously delays jobsite progress and compliance with scheduled completion dates. Frequently, proper draft is not maintained in the shower floor when the slurry is poured. This creates water accumulation in the shower floor and can even lead to directing water to the bathroom floor, thereby creating slip hazards for the end user and caregivers.

Thus, there is seen in the art a need for self sustaining base that is used with a shower stall.

SUMMARY OF THE INVENTION

Disclosed is a base for a shower stall having at least one flanged edge. The base comprises a sloped top and a substantially flat surface positioned opposite the top, wherein the flat surface is substantially flush with the flanged edge. The base also includes a first layer of fiber glass and resin, and layer of filament material, and a second layer of fiberglass and resin. The base also includes at least one external edge, an external opening, and a thickness that increases from the at least one external edge to the internal opening.

A support for a shower stall is also disclosed. The support comprises a sloped floor having at least one flanged edge and a base attached to the sloped floor. The flanged edge includes an end surface positioned distal from the sloped floor. The base includes a substantially flat surface positioned opposite the attachment of the base to the sloped floor and substantially parallel to the end surface. The substantially flat surface is positioned in substantially the same plane as the end surface.

A shower stall is also disclosed. The shower stall comprises a plurality of shower walls, a sloped floor attached to the shower walls, and a base attached to the slope floor. The base includes a first layer of fiberglass and resin, a layer of filament material, and a second of fiberglass and resin. The slope floor further includes a plurality of flanged edges, a drain point or drain opening, and an incline, wherein the incline of the sloped floor decrease from the flanged edges to the opening. The base includes at least one external edge and an internal opening, wherein the base decreases in thickness from the external edge to the internal opening. The base also includes a flat surface positioned opposite the attachment of the base to the sloped floor.

A method of attaching a base to a shower stall is also disclosed. The method comprises creating the base by applying fiberglass, resin, and filament material to a mold, engaging the base to the shower stall by removably attached the mold to the shower stall, curing the base, and removing the mold from the shower.

The base, support, shower stall, and method for making the same used in conjunction with the following disclosure are used to decrease the manufacturing process for barrier free showers. For example, the method adds less than two minutes to the standard manufacturing time of a shower stall and save hours on the installation time of a barrier free shower.

The base, support, shower stall, and method are not present in the prior art. Most of the prior art items do not add the same type of base to barrier free shower installations as is disclosed herein. Additionally, any base that these prior art items may have requires ten times the amount of manufacturing time as require with the inventions include herein.

The shower unit with the "self-sustaining base" can be installed in standard alcoves for barrier-free showers. These showers can be installed by standard procedures of preparing the area, setting the unit into place, leveling the unit horizontally and vertically, shimming the bottom back side and screwing the flanges into the studs. This product will withstand normal use including bathing while remaining in the wheelchair. This product will not have to be reinforced underneath as is necessary with all other fiberglass barrier-free shower units. The shower unit will maintain the floor draft as designed from the mold and prevent the accumulation of water and prevent water from escaping over the threshold into the bathroom floor.

Therefore, it is a general object of the present invention to provide a self sustaining base for a shower stall.

Another object of the present invention is to provide a shower stall base comprising multiple layers of fiberglass, resin, and filament material.

Still another object of the present invention is to provide a base for a shower stall that conforms to the slope of the shower stall and contains a flat surface for leveling of the shower stall.

Another object of the present invention is to provide a shower stall that includes an integral base attached to the shower stall prior to installing the shower stall.

Still another object of the present invention is to provide a shower stall that has a multi-layer base positioned underneath the floor of the shower stall and align to horizontally level the shower stall upon installation.

Yet another object of the present invention is to provide a method of attaching a base under the floor of a shower stall prior to installing the shower stall.

Other further objects, features, and advantages of the present invention will be readily apparent to those skilled in the art upon a reading of the following disclosure when taken in conjunction with the accompanying drawings.

DESCRIPTION OF THE PREFERRED EMBODIMENTS

Figure 1:
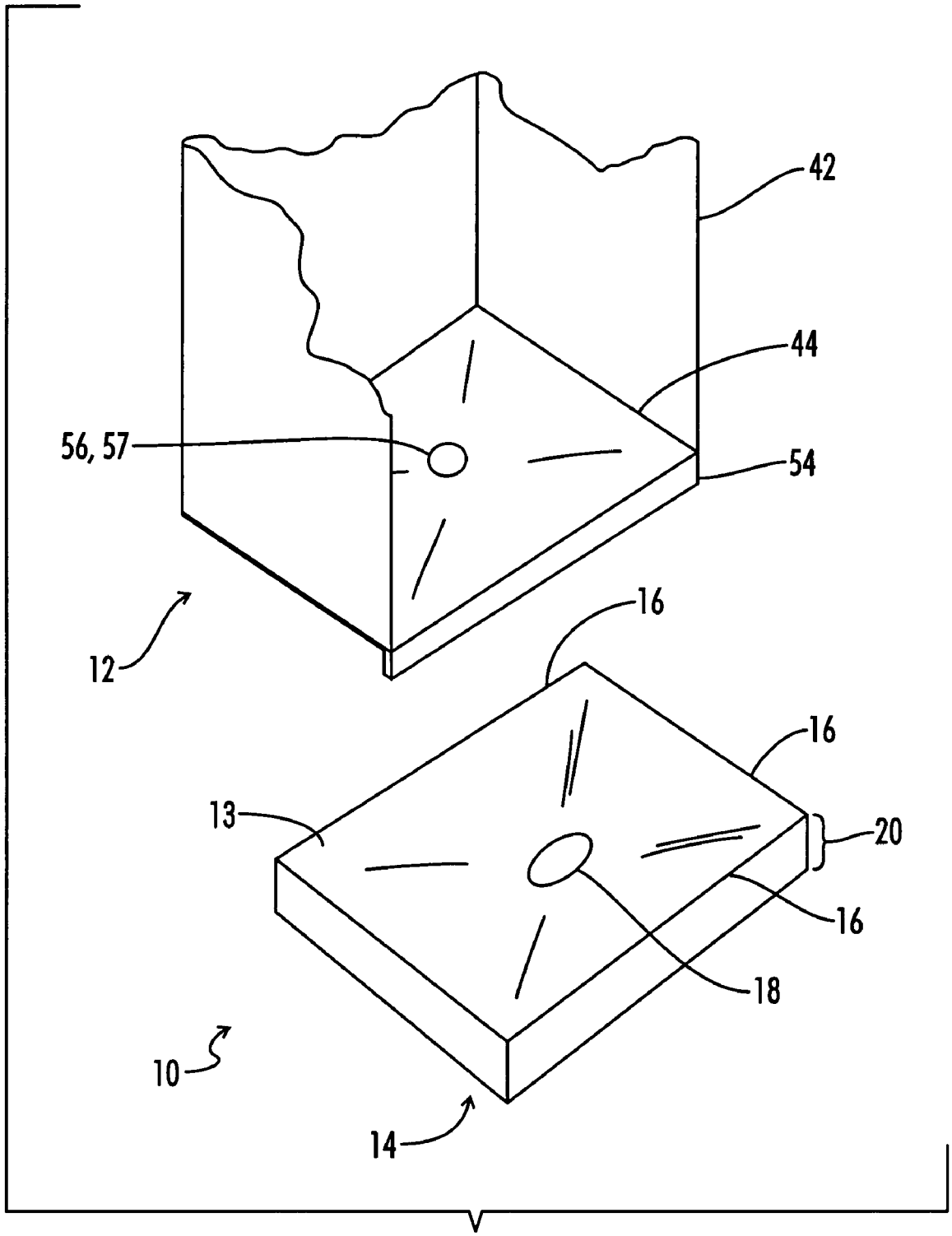
FIG. 1 shows a partial perspective assembly view of one embodiment of a base and shower stall of the current invention.

Referring now to FIG. 1, the base of the present invention is shown and generally designated by the numeral 10. The base 10 is used in conjunction with a shower stall 12 having at least one flanged edge 54. The base 10 comprises a sloped top 13 and a bottom 14, also called a substantially flat surface 14. The flat surface 14 is positioned opposite the top 13 so that the flat surface 14 is substantially flush with the flanged edge 54. The top 13 slopes from the external edge 16 to the internal opening 18. The location of the internal opening 18 within the base 10 can vary inside the base 10 and still allow the flow of fluid through the base 10.

Figure 6:
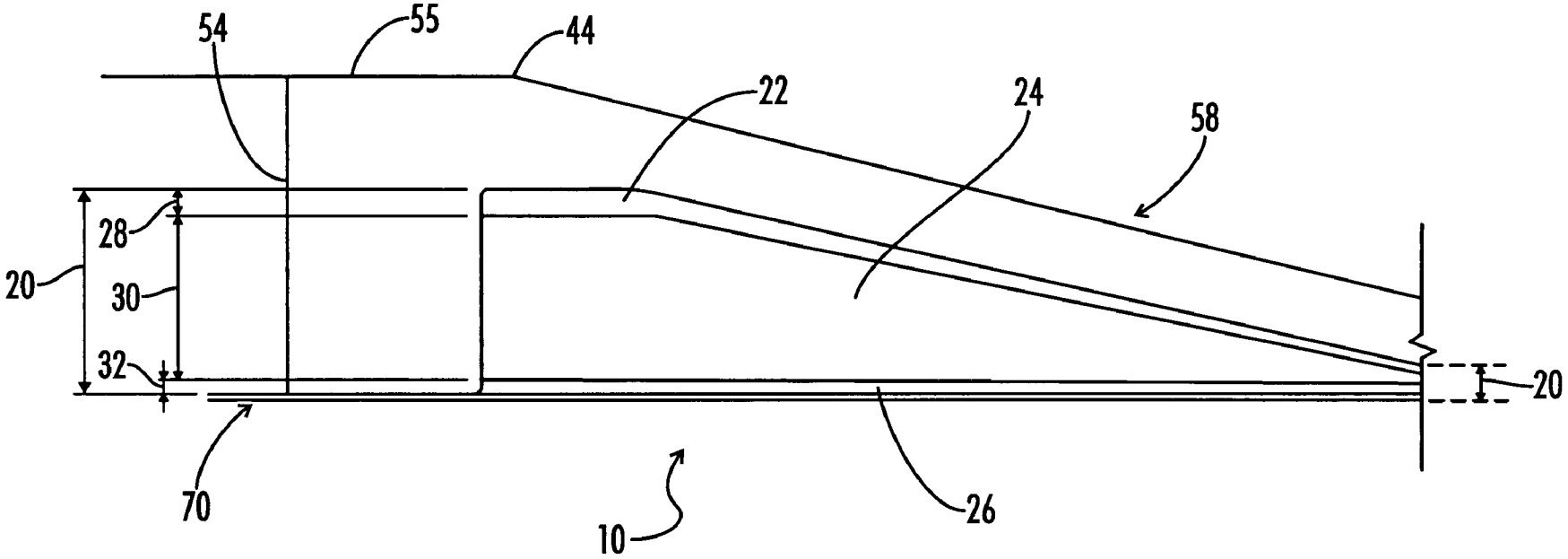
FIG. 6 is a partial cross-sectional view of a base and a shower stall floor showing the various layers of the base made in accordance with the current invention.

The base 10 comprises at least one external edge 16, an internal opening 18, and a thickness 20 that decreases from the external edge 16 to the internal opening 18. As seen in FIG. 6, the base 10 also comprises a first layer of fiberglass and resin 22, a layer of filament material 24, and a second layer of fiberglass and resin 26. Each layer 22, 24, and 26 has a thickness 28, 30, and 32, respectively, that decreases from the external edge 16 to the internal opening 18. However, the amounts of the first layer of fiberglass resin 22, the layer of filament material 24, and the second layer of fiberglass and resin 26 can vary according to the desires of user of the base 10.

In a preferred embodiment, the base 10 includes a number of external edges 16 to correspond with the number of sides, or walls, of the shower stall 12 to which the base 10 is used in conjunction with. As such, the base 10 can have a varied geometrical configuration and the external edges 16 can have a varied geometrical shape. For example, the base can be square, rectangle, oval, circular, or almost any polygonal shape that corresponds with the shower stall 12 and construction subfloor 70 to which the base 10 engages. In a most preferred embodiment, there are four external edges 16 to correspond with the normal quadrilateral cross-sectional shape of the common shower stall 12.

The base 10 can also be described as a base 10 for a low threshold shower stall 12. The base 10 includes a sloped top 13, a substantially flat surface 14, and a thickness 20 of less than three (3) inches. This thickness 20 is important to correspond with the ADA threshold limits. In a preferred embodiment, the thickness 20 is less than two (2) inches.

Figure 7A:
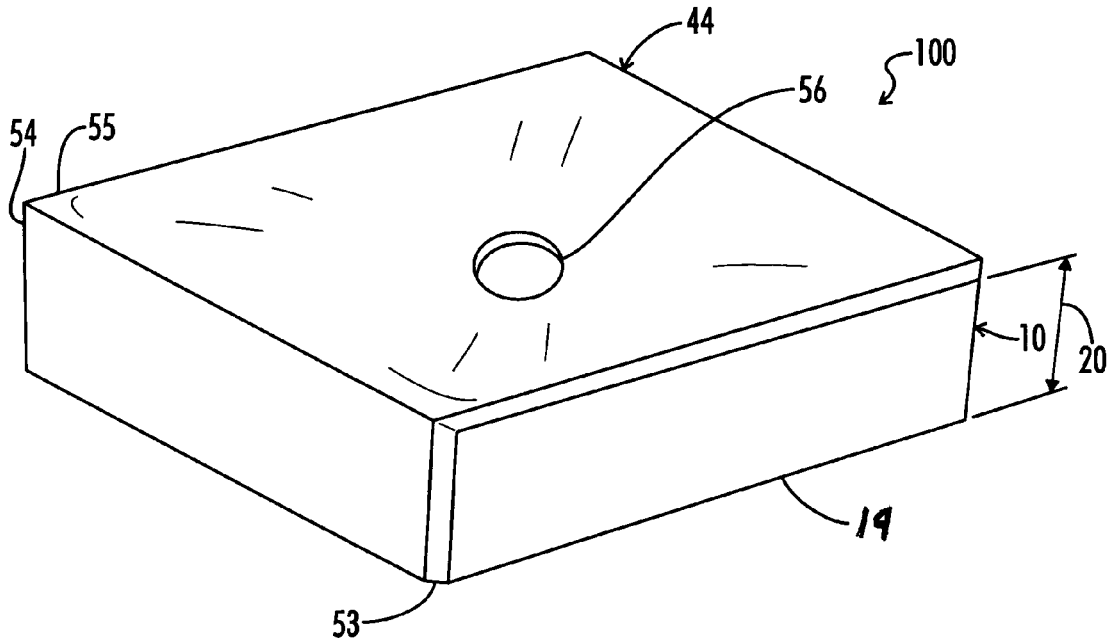
FIG. 7A shows a perspective view of one embodiment of the support of the current invention.
Figure 7B:
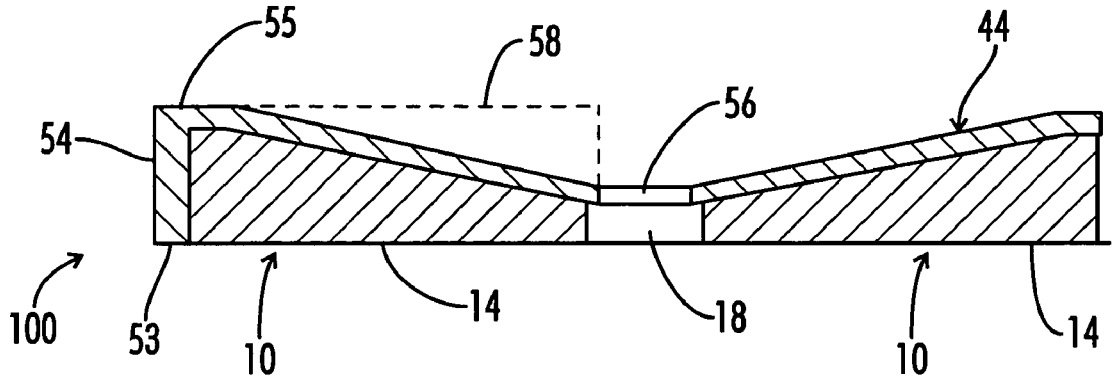
FIG. 7B is a cross-sectional view of a support showing the floor and the base.
Figure 7C:
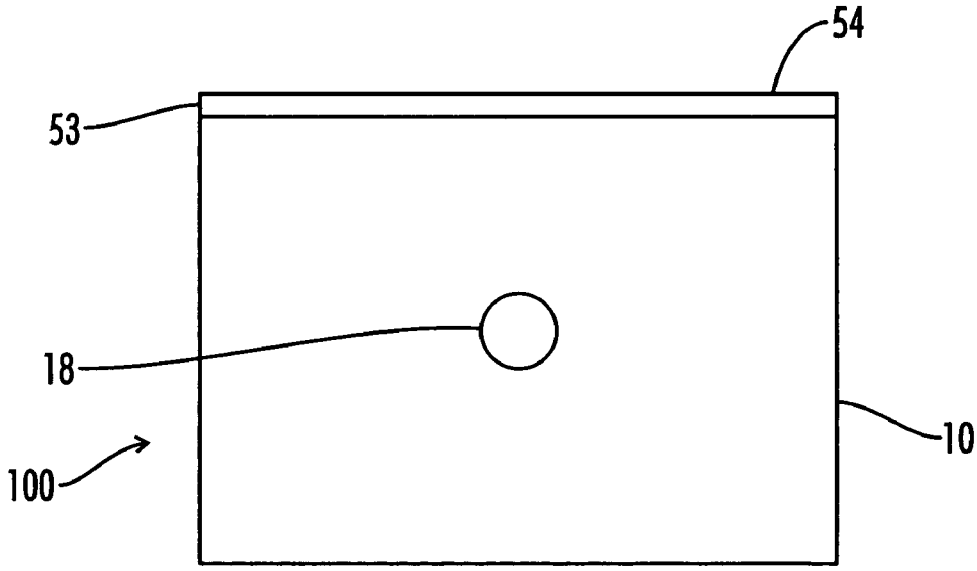
FIG. 7C is a bottom view of the support of the current invention.

Referring now to FIGS. 7A–7C, an embodiment of the support of the present invention is shown and generally designated by the numeral 100. The support 100 comprises a sloped floor 44 and a base 10. The sloped floor has at least one flanged edge 54, the flanged edge having an end surface 53, which can also be described as a free end 53, positioned opposite the connection of the flanged surface 54 and the sloped floor 44. The base 10 is attached to the sloped floor 44 and includes substantially flat surface 14 positioned opposite of the attachment of the base 10 to the sloped floor 44. The flat surface 14 is also positioned to be substantially parallel to the end surface 53, or to be substantially the same plane as the end surface 53. As such, the flat surface 14 can be positioned in a plane that is slightly higher or slightly lower than the plane containing the end surface 53.

The support 100 further includes at least one external edge 16, an internal opening 18, and a thickness 20 that decreases from the external edge 16 to the internal opening 18. As seen in FIG. 6, the support 10 also comprises a first layer of fiberglass and resin 22, a layer of filament material 24, and a second layer of fiberglass and resin 26. Each layer 22, 24, and 26 has a thickness 28, 30, and 32, respectively, that decreases from the external edge 16 to the internal opening 18. However, the amounts of the first layer of fiberglass resin 22, the layer of filament material 24, and the second layer of fiberglass and resin 26 can vary according to the desires of user of the support 100.

Figure 2:
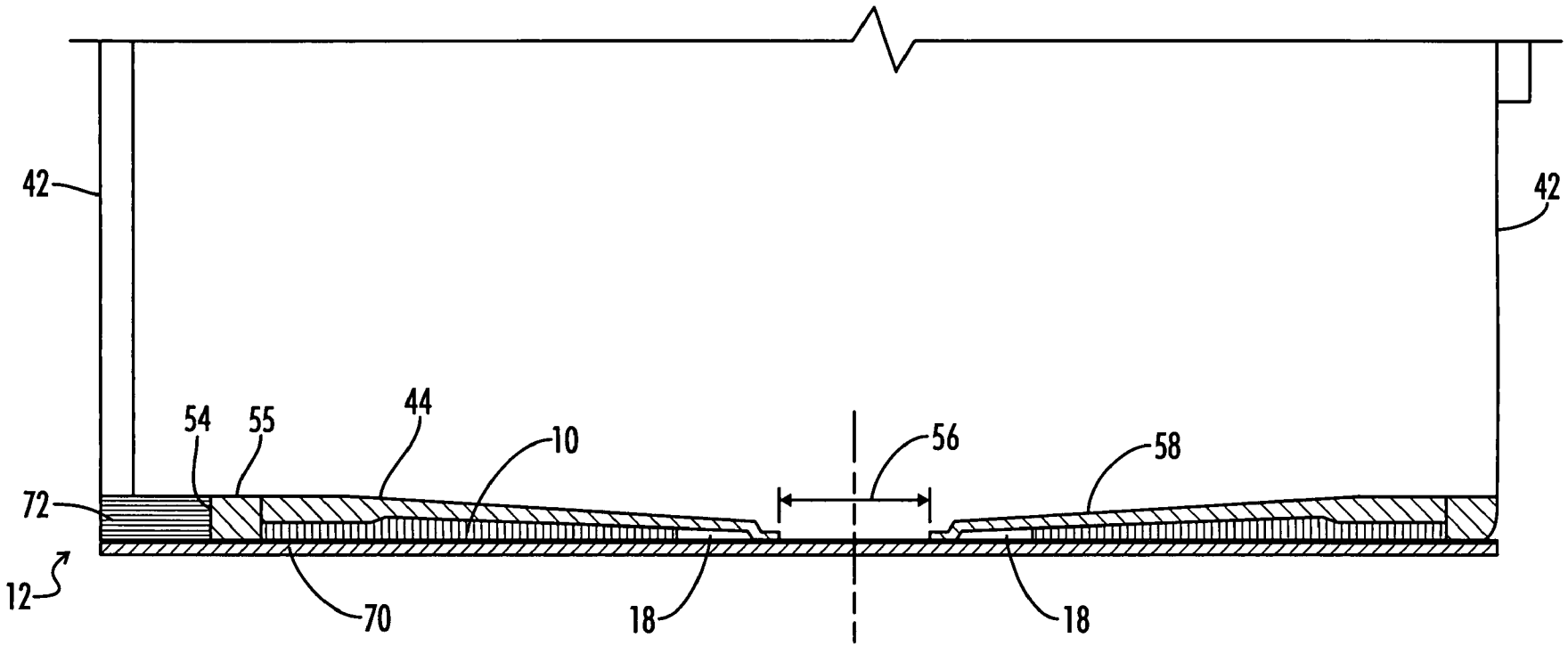
FIG. 2 is a partial side view of a shower stall made in accordance with the current invention.

Referring now to FIG. 2, a shower stall 12 is also disclosed. The shower stall 12 comprises of plurality of shower walls 42, a sloped floor 44, also known as an incline floor 44, attached to the shower walls 42, and a base 10 attached to the sloped floor 44. The base 10 includes a first layer of fiberglass and resin 22, a layer of filament material 24, and a second layer of fiberglass and resin 26.

The shower stall 12 is designed to include the base 10 as part of its assembly and structure prior to the installation of the shower stall 12 into a bathroom or lavatory. This preassembled feature facilitates ease of installation of the shower stall 12.

The sloped floor 44 of the shower stall 12 also includes a plurality of flanged edges 54, a drain opening 56 to which the slope feeds, and an incline 58. The incline 58 of the slope floor 44 decreases, or falls, from the flanged edges 54 to the drain opening 56, which can be a drain point 57, to which the slope feeds. At least one of the flanged edges 54 includes a flush surface 55 that is positioned to be substantially flush with the finished bathroom floor 72.

Also, the base 10 includes a thickness 20, at least one external edge 16, and an internal opening 18. The base 10 decreases in thickness 20 from the external edge 16 to the internal opening 18. In a preferred embodiment, the numbered external edges 16 correspond with the number of flanged edges 54 that are in the sloped floor 44. Also, the drain opening 56 is aligned with the internal opening 18. The base 10 also includes a flat surface 14, also called a bottom 14, located opposite the attachment of the base 10 to the slope floor 44. The flat surface 14 of the base 10 facilitates installation of the shower stall 12 into the bathroom where the shower stall 12 shall be used. The base 10 includes a top 13 that conforms to the shape of the sloped floor 44.

In an alternate embodiment, the shower stall 12 can include multiple drain openings 56 or drain points 57, while the base 10 can include internal openings 18 that correspond with or are offset from the drain openings 56 of the slope floor 44.

The base 10 is level and in a horizontal plain to provide level placement of the shower stall 12 in the bathroom to which the shower stall 12 is used. The base 10 supports the sloped floor 44 of the shower stall 12 by corresponding to, or matching, the incline 58, also called the draft 58, of the sloped floor 44 of the shower stall 12. The top 13 of the base 10 matches this draft 58 while the bottom 14 of the base 10 maintains a horizontal plain and is substantially parallel to the construction sub-floor 70 located in the bathroom to which the shower stall 12 is to be used. This configuration of the top 13 and bottom 14 of the base 10 facilitates a substantially flush alignment of the finished bathroom floor 72 and the flush surface 55, or mating surface of the flanged edge 54.

The fasteners 84, or mounting fixtures 84, for the mold 80 allow the mold 80 to be positioned to remain horizontal for the various corresponding threshold settings of a shower stall 12.

Figure 3:
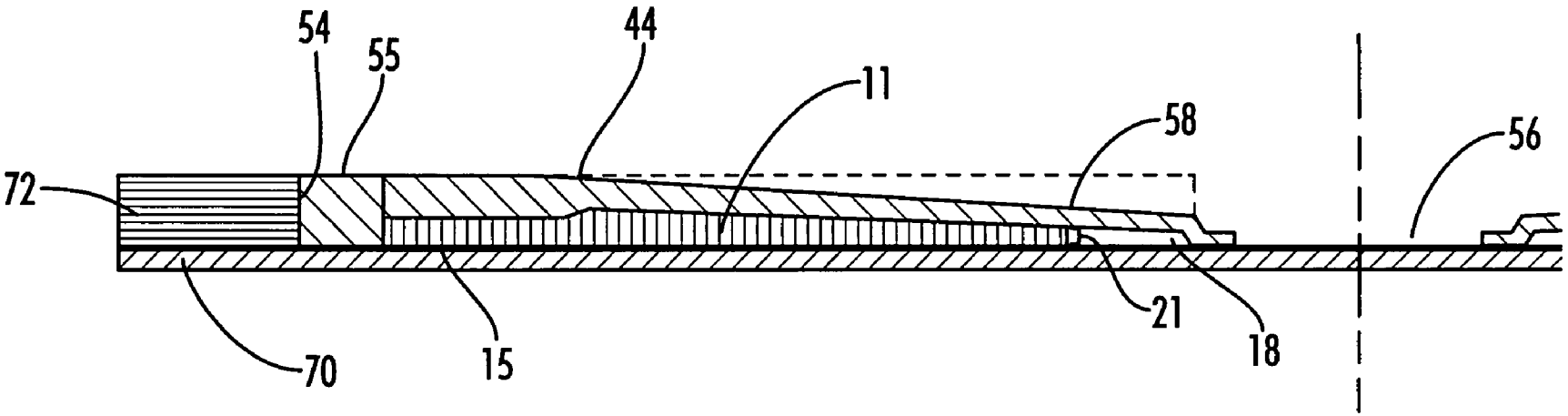
FIG. 3 is a partial cross-sectional view of one embodiment of a base and a shower stall floor made in accordance with the current invention. In this embodiment the thickness of the base includes multiple variances.
Figure 4:
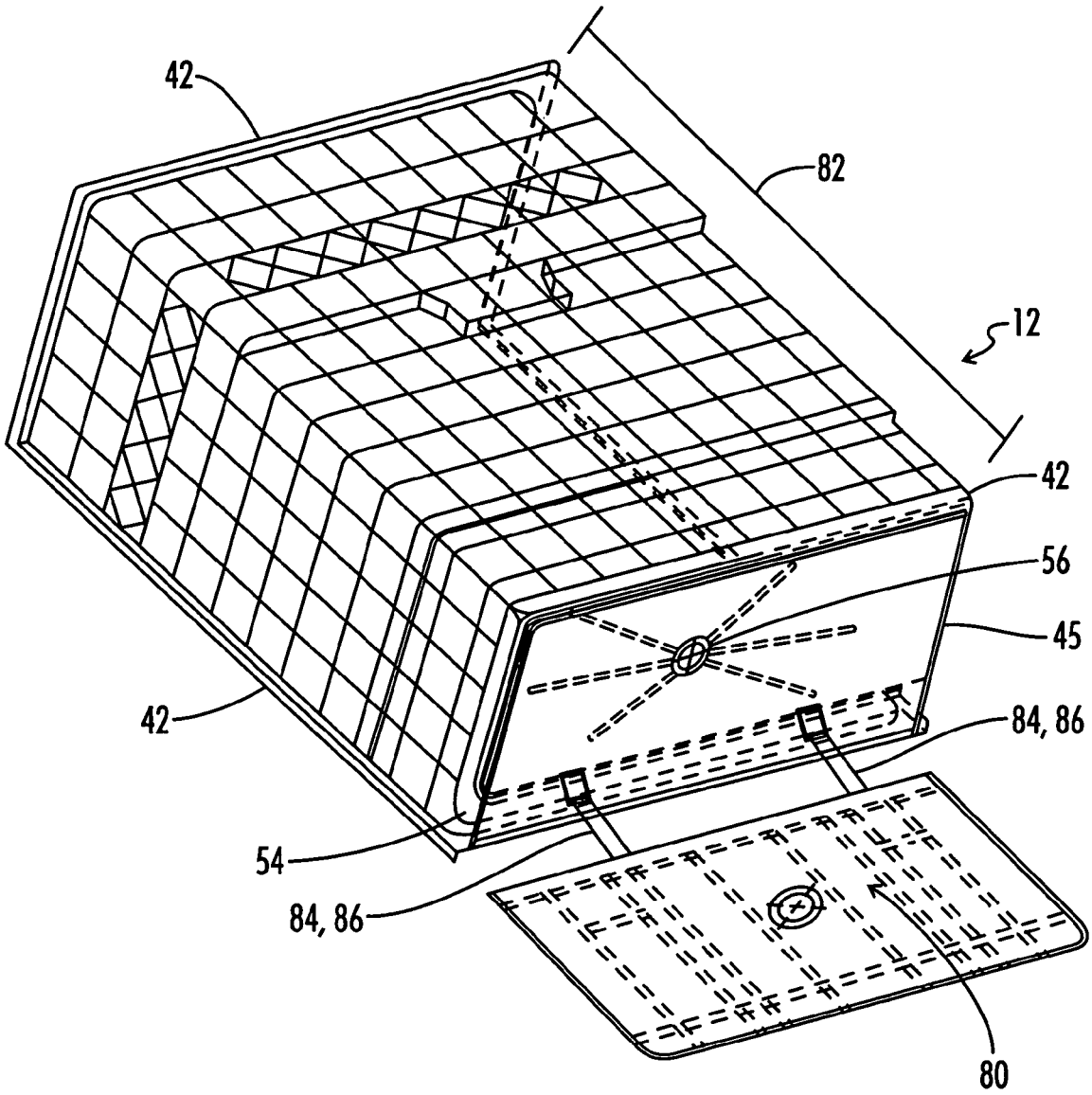
FIG. 4 is a perspective bottom view of a shower stall with a removable mold attached.
Figure 5:
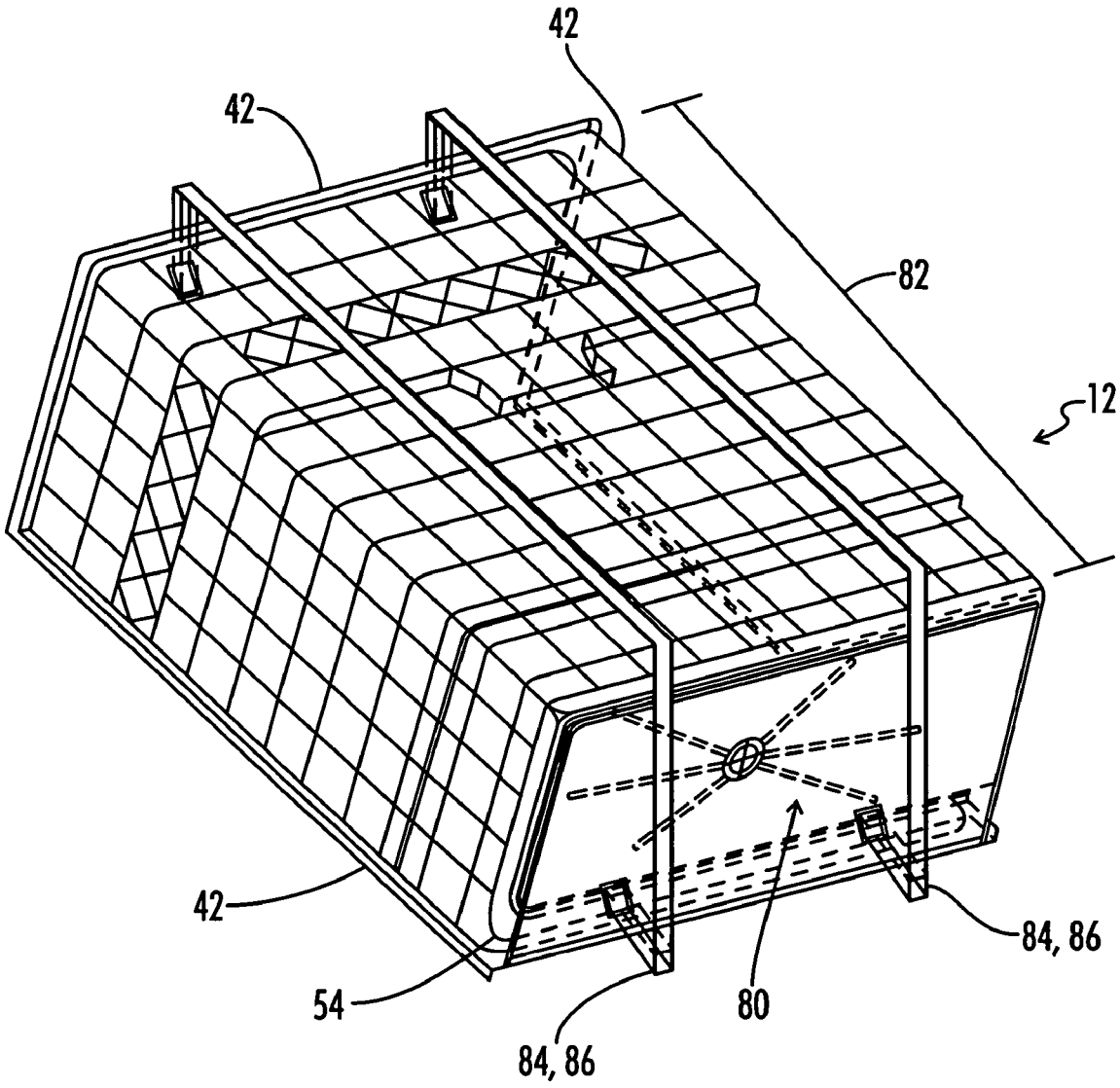
FIG. 5 is a perspective bottom view similar to FIG. 4 with a shower stall with the removable mold positioned in place to allow curing of the base to the shower stall.

As shown in FIG. 3, alternate embodiments of the base 11 can conform to the shape and geometrical configuration of the shower floor 44. In this embodiment the thickness of the base includes multiple variances. This base 11 includes an exterior section 15 that varies in thickness as the thickness of the shower floor 44 varies in thickness. As such, the thickness 21 can both increase and decrease inwardly to match the shape of the shower floor 44.

Methods

A method of attaching a base 10 to a shower stall 12 is disclosed. The method comprises creating the base 10 by applying fiberglass, resin, and filament material to a mold 80, also known as a platform 80 or a plate 80. The method includes engaging the base 10 to the shower stall 12 by removably attaching the mold 80 to the shower stall 12, curing the base 10 and removing the mold 80 from the shower stall 12.

The method includes removably attaching the mold 80 so that the base 10 is substantially perpendicular to the length 82 of the shower stall 12. The method also includes removably attaching the mold 80 substantially parallel to the sloped floor 44 of the shower stall 12. The placement of the base 10 substantially parallel to the sloped floor 44 can also be described as placing the base 10 substantially parallel to the flush surface 55 of the sloped floor 44. Placing the base 10 is such a position facilitates the correcting installation of the shower stall 12 in the bathroom.

In a preferred embodiment, the method includes adhering the base 10 to the underside 45 of the shower stall 12. Also, the method includes using fasteners 84 to removably attach the mold 80 to the shower stall 12. In a more preferred embodiment, the method includes using straps 86 to removably attach the mold 80 to the shower stall 12.

An alternate embodiment, the method includes applying fiberglass, resin, and filament material in multiple layers. In a more preferred embodiment, the method includes first applying the fiberglass and resin and then applying the filament material. In a most preferred embodiment, the method includes applying a first layer of fiberglass and resin 22, then applying a layer of filament material 24, and then applying a second layer of fiberglass and resin 26.

The "self-sustaining base" 10 can be applied in the following manner. A plate 80 is mounted to the shower stall with substantially the same dimensions and shape of the body, or footprint of the shower stall 12. The plate 80 includes a "cut out" area where the drain opening 56 of the shower stall 12, or shower 12, will be. The plate 80 is positioned substantially perpendicular to the sloped floor 44, or floor 44, of the shower 12. Next, fiberglass and resin, approximately 90 mils in thickness, is applied to the plate 80. Filament material, approximately 25 mils in thickness, is placed over the fiberglass and resin on the plate 80. The filament material is then turned over and fiberglass and resin is applied to the other side. Next approximately 30 mils of fiberglass and resin are applied to the underside 45 of the shower. The plate 80 is then folded into a position that is substantially parallel with the plane of the shower floor 44. The plate 80 sustains this position until the sprayed materials are cured. The fiberglass, resin, and filament material can be applied by numerous methods know in the art. In a preferred embodiment, these items are applied by spraying.

In one embodiment, the base 10 is created by applying a fiberglass resin to a slick metal or a fiberglass platform 80 mounted to the shower unit 12. Next, a filament material is placed on the plate 80. Then, fiberglass and resin are sprayed on the filament material. While all the material is in a hydrated state, the plate 80 is folded up into the space created by the incline 58 of the slope 44 of the shower unit 12. The plate 80 is then secured to maintain a perpendicular angle to the facing flange 54 of the shower stall 12. Finally, once the materials have completed the cure phase, the plate 80 is released and removed. Then the shower stall 12 is ready for application into a bathroom.

The implementation of the base 10 as part of the support 100 and the base 10 as part of the shower stall 12 can occur at any time during the production of the support 100 or shower stall 12, respectfully. In a preferred embodiment of the support 100, a second mold (not shown) is used to form the sloped floor 44 and remains engaged to the sloped floor 44 while the base 10 cures with the sloped floor 44 to create the support 100. In a preferred embodiment of the shower stall 12, a third mold (not shown) is used to form the shower stall 12 and remains engaged to the shower stall 12 while the base 10 cures with the remainder of shower stall 12. The curing phase of the base 10 occurring concurrently and in conjunction with the second and third molds engaging the sloped floor 44 and shower stall 12, respectfully, facilitates the proper formation of the base in relation to the sloped floor 44 and shower stall 12. This is due to the nature of the materials used and to the curing stages of the base 10, sloped floor 44, and shower stall 12 and associated shrinkages and distortions in the base 10, sloped floor 44, and shower stall 12.

Thus, although there have been described particular embodiments of the present invention of a new and useful Self-Sustaining Base, it is not intended that such references be construed as limitations upon the scope of this invention except as set forth in the following claims.

What is claimed is:

1. A base for supporting the floor of a shower stall, the floor of said shower stall having a perimeter and a drain point within the bounds of said perimeter and the floor sloping from said perimeter to said drain point, and said shower stall having at least one flanged edge, the base comprising:

a sloped top shaped and sized to substantially mirror the slope of the shower stall floor;

a substantially flat surface positioned opposite the top, wherein the flat surface is substantially flush with the flanged edge;

at least one external edge;

an internal opening;

a first layer of fiberglass and resin, a layer of filament material;

a second layer of fiberglass and resin; and wherein the top slopes from the at least one external edge to the internal opening.

2. The base of claim 1, wherein each layer has a thickness that decreases from the at least one external edge to the internal opening.

3. A base for a low threshold shower stall comprising:

a sloped top:

a substantially flat bottom:

a thickness of less than three inches between said top and bottom;

a first layer of fiberglass and resin, a layer of filament material; and a second layer of fiberglass and resin.

4. The base of claim 3, wherein the thickness is less than 2 inches.

5. The base of claim 3, further including at least one external edge;

an internal opening; and wherein the top slopes from the at least one external edge to the internal opening.

6. The base of claim 3, wherein each layer has a thickness that decreases from the at least one external edge to the internal opening.

7. A shower stall comprising:

a plurality of shower walls;

a sloped floor attached to the shower walls; and a base attached to the sloped floor and including a first layer of fiberglass and resin, a layer of ifiament material, and a second layer of fiberglass and resin, said base having a substantially flat surface positioned substantially perpendicular to said walls.

8. The shower stall of claim 7, wherein the sloped floor further includes a plurality of flanged edges, a drain opening, and an incline, wherein the incline of the sloped floor decreases from the flanged edges to the drain opening.

9. The shower stall of claim 8, wherein base further includes a thickness;

at least one external edge;

an internal opening; and wherein the base decreases in thickness from the at least one external edge to the internal opening.

10. The shower stall of claim 9, wherein the drain opening is aligned with the internal opening.

11. The shower stall of claim 7, wherein the base includes a flat surface located opposite the attachment of the base to the sloped floor.

12. The shower stall of claim 7, wherein each layer includes a width that decreases from the at least one external edge to the internal opening.

13. The shower stall of claim 7, wherein the base further includes a top that conforms to the shape of the sloped floor.

* * * * *